US006461248B1

(12) United States Patent
Gross

(10) Patent No.: US 6,461,248 B1
(45) Date of Patent: Oct. 8, 2002

(54) ELECTRONIC GOLF BALL PUTTER

(76) Inventor: Robert V. Gross, 502 D Ridgefield Cir., Clinton, MA (US) 01510

( * ) Notice: Subject to any disclaimer, the term of this patent is extended or adjusted under 35 U.S.C. 154(b) by 0 days.

(21) Appl. No.: 09/429,138

(22) Filed: Oct. 28, 1999

Related U.S. Application Data

(60) Provisional application No. 60/106,098, filed on Oct. 29, 1998.

(51) Int. Cl.[7] ..... A63B 69/36

(52) U.S. Cl. ..... 473/220; 473/221; 473/222

(58) Field of Search ..... 473/220, 221, 473/222, 219

(56) References Cited

U.S. PATENT DOCUMENTS

| | | | | |
|---|---|---|---|---|
| 5,029,868 | * | 7/1991 | Cloud | 473/220 |
| 5,082,276 | * | 1/1992 | Stevens | 473/220 |
| 5,165,691 | * | 11/1992 | Cook | 473/220 |
| 5,324,039 | * | 6/1994 | Reimers | 473/220 |
| 5,330,188 | * | 7/1994 | Reimers | 473/220 |
| 5,374,063 | * | 12/1994 | Ogden | 483/220 |
| 5,441,269 | * | 8/1995 | Henwood | 473/220 |
| 5,692,965 | * | 12/1997 | Nighan, Jr. et al. | 473/220 |
| 5,692,966 | * | 12/1997 | Wash | 473/221 |
| 5,709,610 | * | 1/1998 | Ognjanovic | 473/220 |
| 5,792,001 | * | 8/1998 | Henwood | 473/220 |

* cited by examiner

*Primary Examiner*—Jessica J. Harrington
(74) *Attorney, Agent, or Firm*—Mirick, O'Connell, DeMallie & Lougee, LLP

(57) ABSTRACT

An electronic golf ball putter, adapted to indicate when the putter is aligned with a target, comprising, a golf putting iron for hitting a golf ball; a power source; a communicator; a transmitter of communications from the communicator; and an indicator capable of indicating alignment between the golf putter iron and the target in response to the transmitter.

2 Claims, 6 Drawing Sheets

ELECTRONIC GOLF BALL PUTTER

This application claims benefit of provisional application Ser. No. 60/106,098, filed Oct. 29, 1998.

FIELD OF THE INVENTION

This invention relates to golf ball putters, and more specifically to a putter designed to electronically indicate when the face of the golf ball putter is aligned with a target.

BACKGROUND OF THE INVENTION

One of the challenges of golf is the short game or the portion of the game that is played on or in close proximity to a golf green. Whether or not a person is successful at the short game depends in part on the person's ability to properly align the face of their putting iron with the hole on the green. Devices are known which improve a player's swing and which improve the consistency of a player's swing. There are also visual aides for aligning the head of the putter with the hole, such as the small groove on the top of the putter head. However, such aides are only minimally helpful and certainly do not assist someone who has an eyesight impairment.

Therefore, a need is identified for a device that more readily helps a player to align the face of a putting iron with the hole on a golfing green and more particularly, a device that provides an audible aide rather than merely a visual aide to enable a person with an eyesight impairment to readily align a putting iron with the golf hole.

SUMMARY OF THE INVENTION

It is therefore a primary object of this invention to provide a golf ball putting device that produces an audible indication that the face of the putter is aligned with a target golfing hole.

It is a further object of this invention to provide an electronic golf ball putter that utilizes an infrared beam of light, a reflector and a sensor to determine whether the putter is properly aligned with a target.

It is a further object of this invention to provide a golf ball putter capable of assisting a visually impaired person to properly align a putting iron with the hole on a golfing green to more readily develop a consistently accurate golf stroke.

It is a further object of this invention to provide a golf ball putter that produces an audible and visual indication that the face of the putter is aligned with a target.

The device of the invention is the result of efforts to design a device that provides an audible aide for persons with an eyesight impairment when lining up a golfing iron with the hole on the green. Although the device is especially useful to those with impaired vision, the device is designed to facilitate the golfing game of any player. It is envisioned that the device may be adapted for other applications in which one object must be aligned with another and visual acuity is less than optimum.

A preferred embodiment of the electronic golf ball putter of the invention which is adapted to indicate when the putter is aligned with a target, comprises: a golf putting iron for hitting a golf ball; a power source; a communicator; a transmitter of communications from the communicator; and a sensor capable of sensor alignment between the golf putter iron and the target in response to the transmitter. The communicator is a light source which is capable of emitting infrared light; wherein the transmitter is preferably a light reflector; and wherein the sensor preferably comprises a means for sensing infrared light. The indicator may further comprise an indicator which emits a sound in response to the means for sensing infrared light.

The communicator and indicator may be fixed to the golf putting iron and the transmitter may be fixed to a means for supporting the transmitter proximate the target, such as a clip which may be adapted to releasably attach to a flag resting in a golf hole.

Another preferred embodiment of the electronic golf ball putter of the invention which is adapted to indicate when the putter is aligned with a target, comprises: a golf putting iron for hitting a golf ball; a power source; a light source; a light reflector; and a sensor capable of sensing alignment between the golf putter iron and the target in response to the reflector; wherein the light source is preferably capable of emitting infrared light; and wherein the sensor may comprise a means for sensing infrared light. The sensor may further comprise an indicator such as a sound emitter adapted to emit or cease one or more sounds in response to the sensor and the power source preferably comprises a battery. Similarly, the light source and the sensor may be fixed to the golf putting iron.

Yet another preferred embodiment of the electronic golf ball putter of the invention which is adapted to indicate when the putter is aligned with a target, comprises: a golf putting iron for hitting a golf ball; a communicator fixed to the golf putting iron; a remote transmitter of communications from the communicator; a power source; and a sensor fixed to the golf putting iron and capable of sensing alignment between the golf putter iron and the target in response to the transmitter; wherein the power source is preferably a battery pack.

Still another preferred embodiment of the electronic golf ball putter of the invention adapted to indicate when the putter is aligned with a target, comprises: a golf putting iron for hitting a golf ball; a communication transmitter provided proximate the target; a power source; a communication receiver, fixed to the golf putting iron, which receives communications from the source; and an indicator capable of indicating alignment between the golf putter iron and the target in response to the communication receiver.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The invention features a golf ball putter capable of determining and audibly and/or visually indicating whether the putter is properly aligned with a target. The preferred embodiment of the device is characterized by: a putting iron fitted with an infrared light source, an infrared sensor and audio and visual indicators; and a portable, remote reflector capable of being releasably mounted to the staff of a golfing flag.

Figure 1:
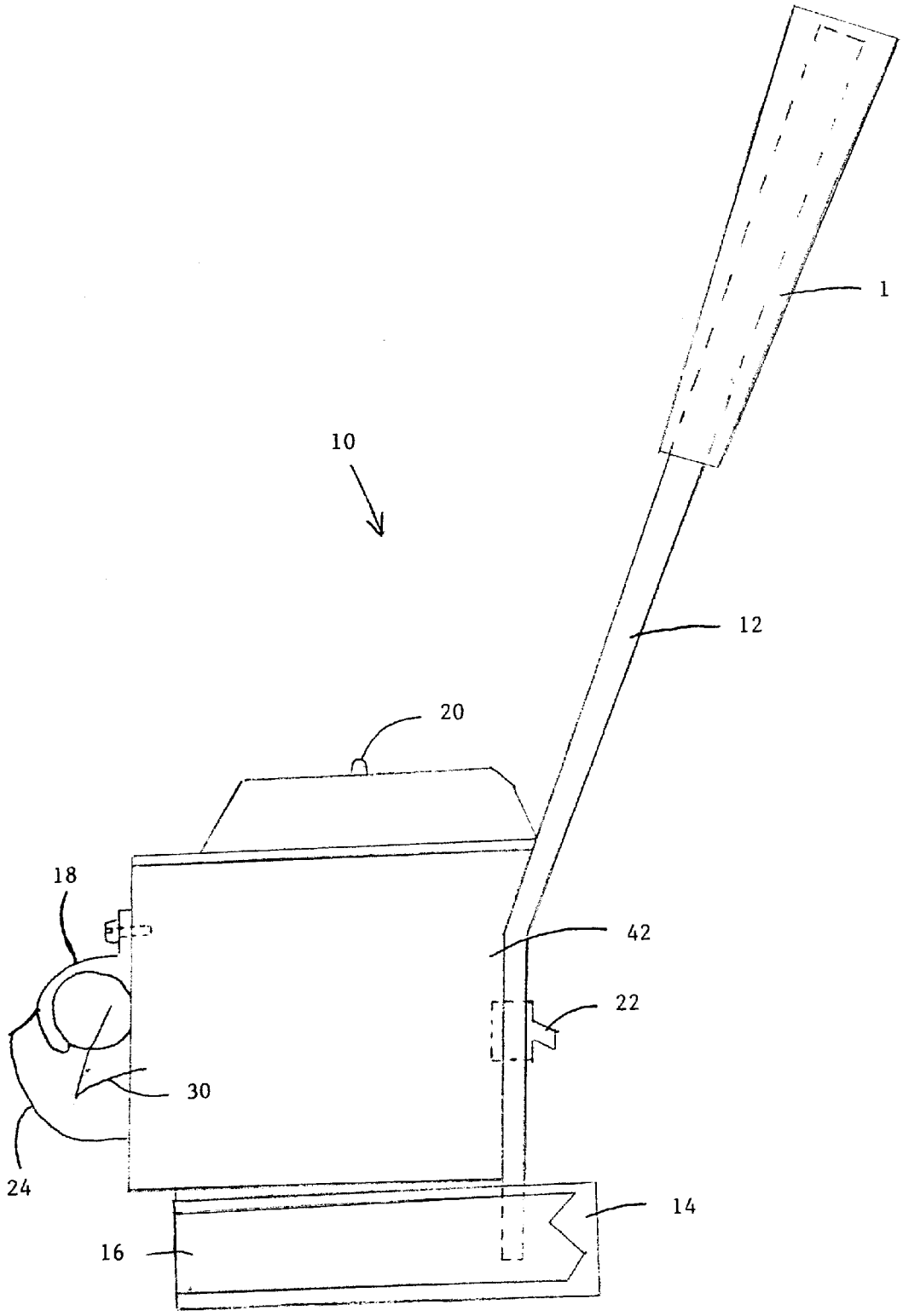
FIG. 1 is a view of the left side of the preferred embodiment of the golf ball putter of the invention.
Figure 2:
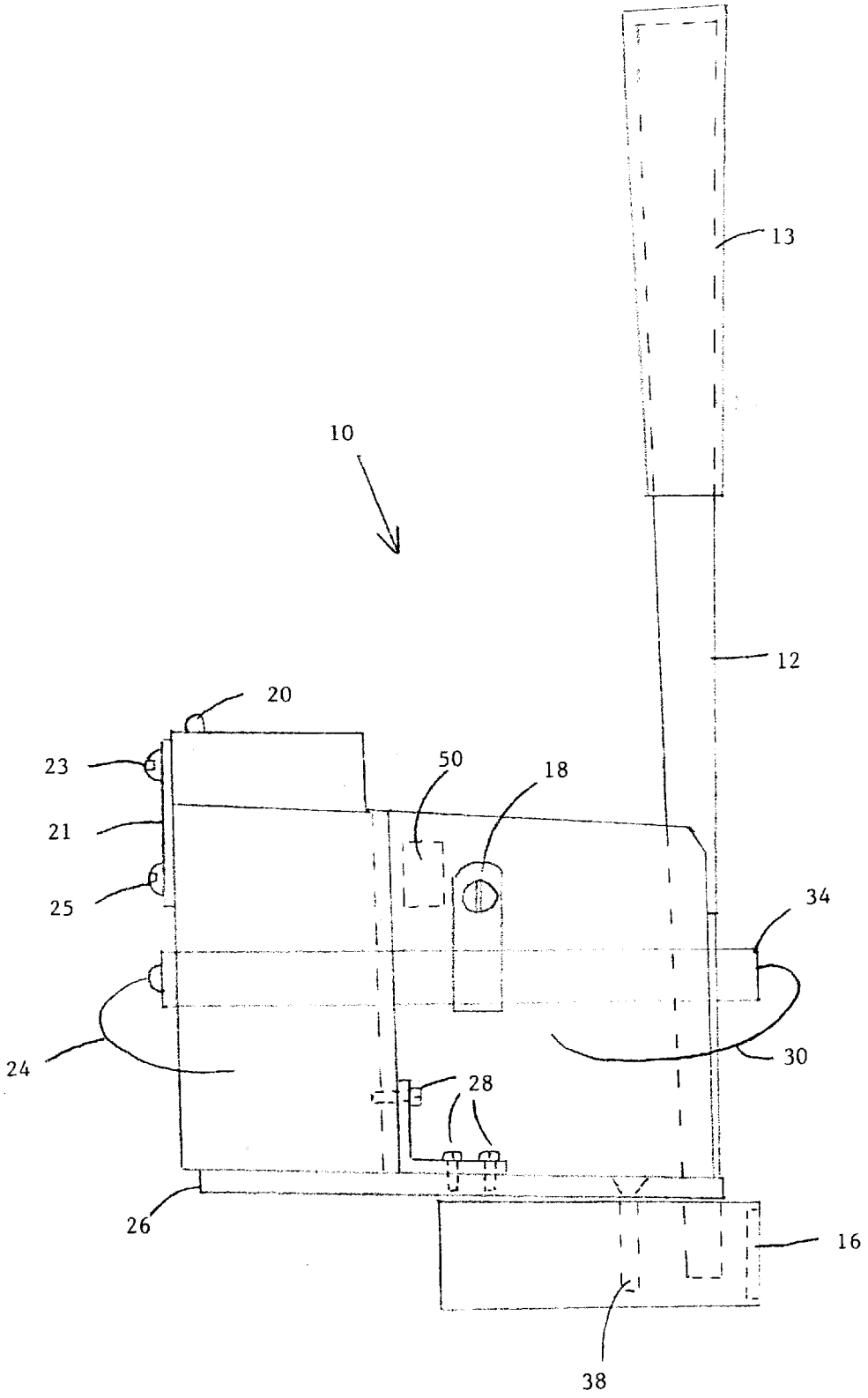
FIG. 2 is a front view of the embodiment shown in FIG. 1.
Figure 3:
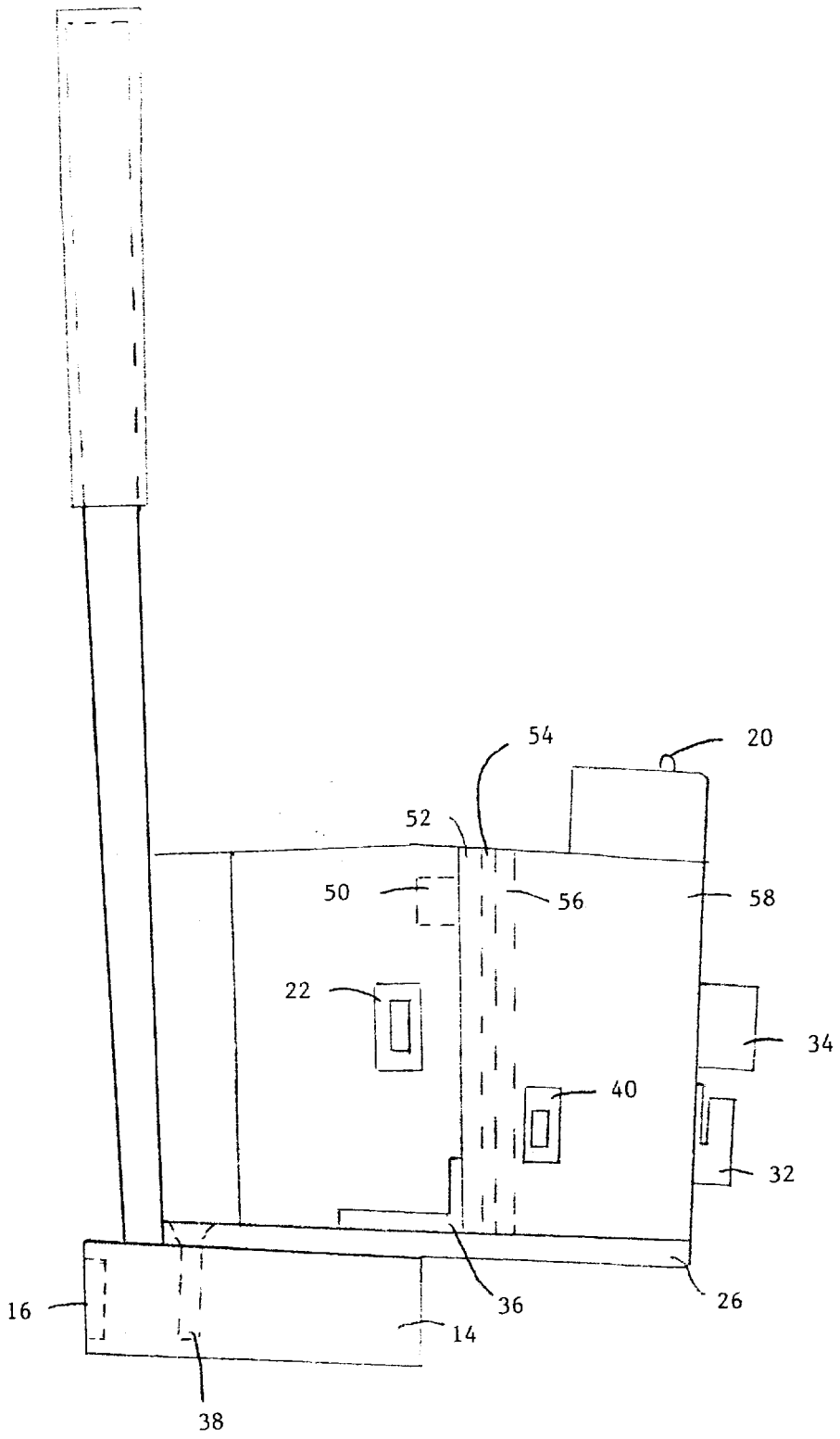
FIG. 3 is a rear view of the embodiment shown in FIG. 1.

The preferred embodiment of the golf ball putter is shown and generally referred to in FIGS. 1, 2 and 3 as device 10. Device 10 includes putting iron 12 fitted with hand grip 13; putting head 14; neoprene insert 16 and housing 42. The shaft of putting iron 12 tapers from about ⅜" at the bottom to about ⅝" at the top. Battery clamp 18 is attached to the front of housing 42 and has a radius of curvature slightly smaller than the radius of curvature of battery case 34 so that the battery case can be snapped into clamp 18 and releasably held in place for easy replacement. Battery case 34 is sized to hold three 12 volt batteries as a power source for device 10. Leads 24 and 30 are each provided with a clamp to connect the battery case with electrical components housed within housing 42. Indicator light 20 and its housing is mounted to the top of housing 42 with plate 21 and screws 23 and 25. Two switches are provided on the rear of housing 42, namely, on/off switch 22 and audio/light switch 40. Switch 22 turns the entire device on and off.

Figure 6C:
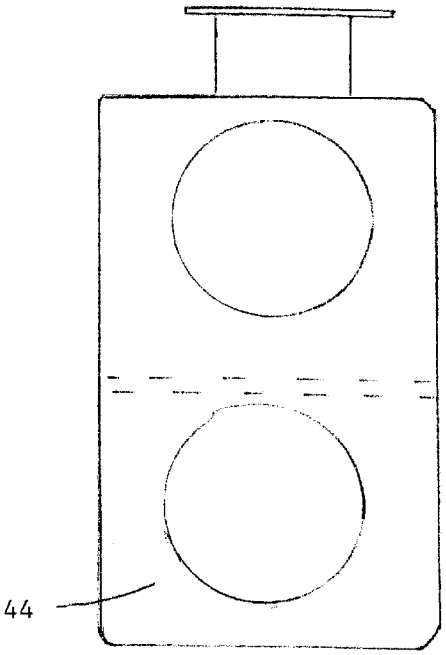
FIGS. 6A–6C are front internal, side and front external views, respectively, of the housing of the embodiment shown in FIG. 1.
Figure 6B:
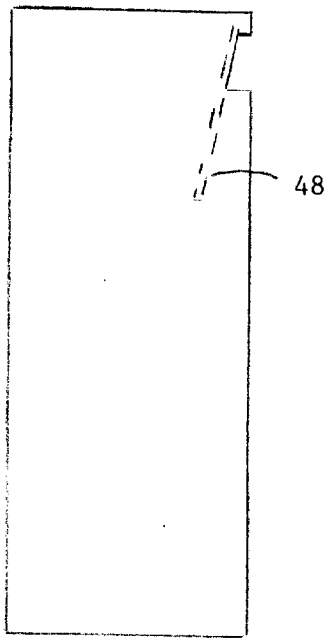
Figure 6A:
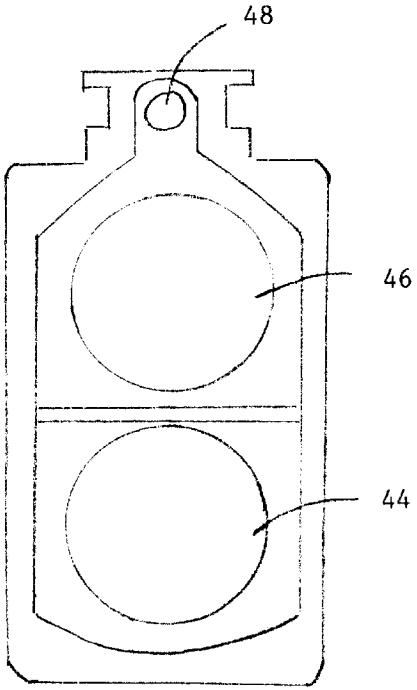

Housing 42 is mounted to pivoting plate 50 which in turn is mounted to plastic plate 52. Pivoting plate 50 enables the user to adjust the height and angle of housing 42 and effect to adjust the position of the light source and sensor housed in housing 42. Plastic plate 52 is mounted to base plate 26 with right angle bracket 36 and screws 28. In turn, plate 26 is mounted to putter head 14 using screw 38. As shown in FIGS. 6A–6C, housing 42 contains an infrared light source 44 which serves as a communicator, a sensor 46 which serves as a means for sensing alignment between the golf putter iron and the target in response to a reflector, mounted to the target, which serves as transmitter of communications from the communicator. Both the light source, which is preferably an infrared source, and the sensor may comprise a mirror or lens to focus the outgoing and incoming light, respectively.

Housing 58 contains circuit board 56, switch 40 which enables the user to select an audio or light indicator or both. An audible sound, such as a buzzer, is emitted through speaker 32 which is also fixed to and directs sound from the right portion of housing 58. Alternatively or in addition, indicator light 20 lights up or flashes. A rubber pad 54 is sandwiched between circuit board 56 and plastic mounting plate 52.

Figure 4:
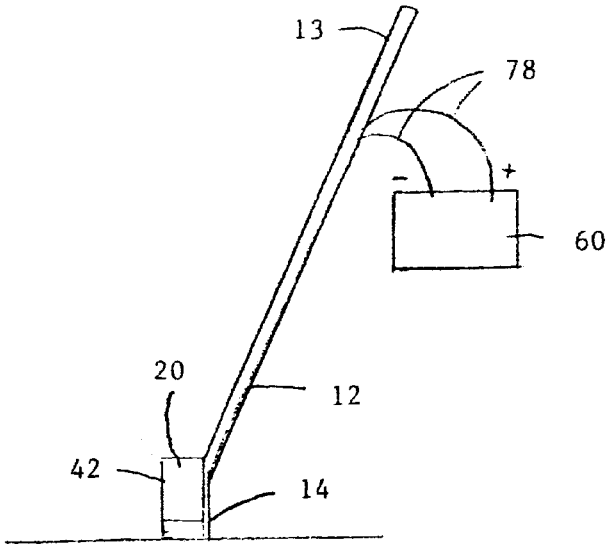
FIG. 4 is a view of the left side of the embodiment shown in FIG. 1 in use.
Figure 7B:
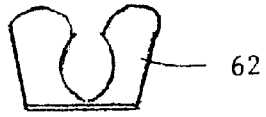
FIGS. 7A and 7B are a front view of the reflector mounted to the flag of FIG. 5A, and a top view of the mounting bracket for this reflector.
Figure 7C:
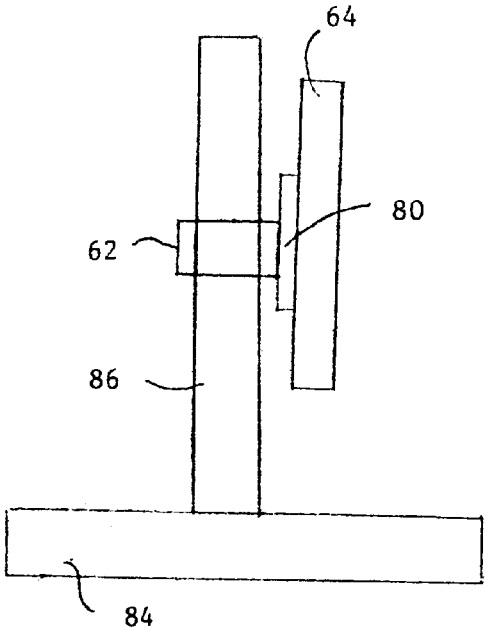
FIG. 7C is a side view of an alternative reflector for use in situations in which a golf flag is not available.
Figure 7A:
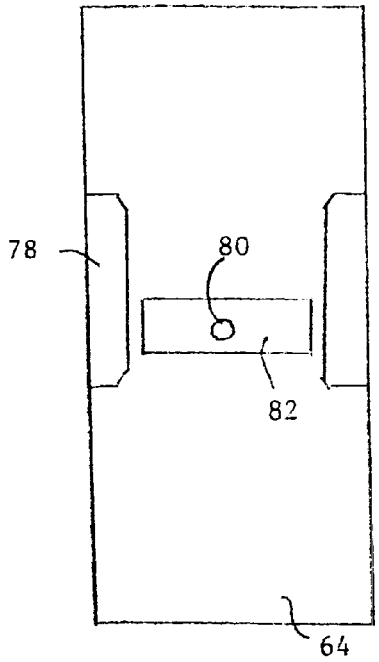
Figure 5B:
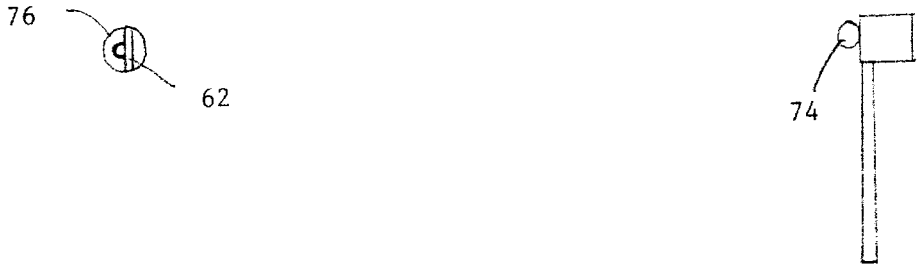
FIG. 5B is a schematic top view of the golf ball putter and reflector shown in FIG. 5A.
Figure 5A:
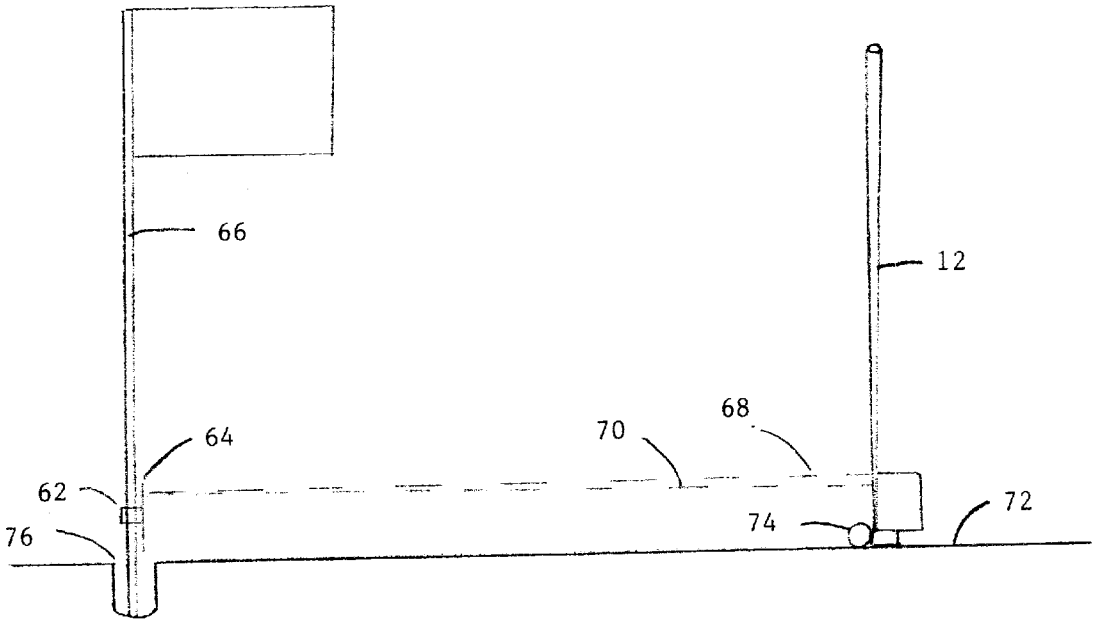
FIG. 5A is a schematic rear view of the golf ball putter shown in FIG. 4 and reflector of the invention in use.

The putting iron and remote reflector are shown in use in FIGS. 4, 5A and 5B. Reflector 64 is mounted to flag staff mounting bracket 62 which frictionally grip flag staff 66 as the flag sits in golf hole 76. Reflector 64 is preferably fixed to mounting bracket 62 (FIGS. 7A and 7B) by sliding the reflector between bracket mounting plate 82 and flanges 78 and fixed in place at bolt 80. Clamp 62 is likewise fixed to the opposite side of plate 82 with the same bolt and is adapted to snap around flag staff 66. The radius of curvature of clamp 62 should be slightly smaller than flag staff 66. If a flag is not available or if the user wants to practice lining up shots without a golf hole, stand 82 (FIG. 7C) may be provided with base 84 and pole 86 to which clamp 62 may be attached. Stand 82 may be placed on any level surface and used as a target.

To use the putter and reflector of the invention, the user places the putter behind golf ball 74 and flips on/off switch 22 to on so that infrared beam 68 is emitted by light source 46. When the putting iron is properly aligned with golf hole 76, infrared beam 68 will reflect off of reflector 64 as reflected beam 70 which, in turn, will be sensed by sensor 44. When sensor 44 picks up the reflected beam, one or both the indicator light 20 and speaker 32 will emit a light and sound, respectively. The device can alternatively be configured to emit the light and sound while the user is lining up the shot and shut off when proper alignment is achieved. A window 48 may be provided in housing 42 so that a user can look into the housing to ensure that the mirrors in the housing are in proper working position.

As an alternative or auxiliary power supply to battery pack 34, the device may comprise battery belt 60 which may be worn around the user's waist and which is connected to housing 58 by leads 78 as shown in FIG. 4. The power source of the invention is not limited to battery power. The device may be powered by solar energy, an electrical cable and outlet or any other suitable energy source.

The device of the invention is not limited to an infrared source, reflector and sensor, and may be substituted or enhanced with other means for communicating including, but not limited to, sources such as other wavelengths of light, radiowaves and microwaves and sensors suited to the particular source. It is also envisioned that the sensor or the source may be located proximate the target rather than on the putter housing, where, in either case, a reflector may not be necessary. The configuration and size of the components are not limited to the embodiment described herein and can be readily reduced in size by someone skilled in the pertinent art.

Although specific features of the invention are shown in some drawings and not others, this is for convenience only as some feature may be combined with any or all of the other features in accordance with the invention.

Other embodiments will occur to those skilled in the art and are within the following claims.

What is claimed is:

1. An electronic golf ball putter alignment system to assist a user in properly aligning the putter putting head with a flagstaff located in a golf hole, comprising:

a golf putting iron for putting a golf ball, the iron including a putting head for striking the golf ball;

an infrared transmitter coupled to the putting iron and transmitting an infrared beam above the putting head and along a desired putting direction;

an infrared reflector coupled to the flagstaff;

an infrared sensor coupled to the putting iron adjacent the infrared transmitter, for receiving infrared light emitted from the transmitter and reflected directly back from the infrared reflector;

at least one of an indicating light and an indicating sound emitter responsive to the infrared sensor for indicating when reflected infrared light is received by the infrared sensor.

2. The system of claim 1, wherein the system comprises an indicating sound emitter, and further comprising means for emitting a sound when reflected infrared light is not received by the infrared sensor.

* * * * *